US005993276A

United States Patent [19]

Ponton et al.

[11] Patent Number: 5,993,276

[45] Date of Patent: Nov. 30, 1999

[54] FLOATING CHILD RESTRAINT ASSEMBLY

[76] Inventors: Carlos Ponton; Victoria Ponton, both of 8515 Old Country Manor #417, Davie, Fla. 33328

[21] Appl. No.: 09/136,197

[22] Filed: Aug. 19, 1998

[51] Int. Cl.[6] ..... B63C 9/08

[52] U.S. Cl. ..... 441/130; 441/80

[58] Field of Search ..... 441/80, 88, 125, 441/126, 127, 129, 130, 131, 132; 297/485, DIG. 11

[56] References Cited

U.S. PATENT DOCUMENTS

| | | | |
|---|---|---|---|
| 2,623,574 | 12/1952 | Damsch . | |
| 4,725,253 | 2/1988 | Politte | 441/130 |
| 4,798,551 | 1/1989 | Dumonceaux et al. | 441/130 |
| 4,861,301 | 8/1989 | Pomeroy et al. . | |
| 4,962,921 | 10/1990 | Simmons . | |
| 5,224,891 | 7/1993 | Stephens | 441/130 |
| 5,358,438 | 10/1994 | Wolfe . | |
| 5,409,411 | 4/1995 | Schrieber . | |
| 5,411,425 | 5/1995 | Rinker . | |
| 5,514,020 | 5/1996 | Gainforth | 441/126 |

*Primary Examiner*—Ed L. Swinehart
*Attorney, Agent, or Firm*—Kenneth L Tolar

[57] ABSTRACT

A floating child seat assembly is disclosed and includes a chair member having a seat portion and a backrest portion perpendicularly depending therefrom. Upper and lower inflatable flotation devices are secured to each side of the chair member to suspend the chair member on the surface of a body of water. A weight is secured to the bottom surface of the seat portion to maintain the chair member in an upright position. The backrest portion has a pair of opposing adjustable straps extending therefrom for securing the child within the chair member. An umbrella is removably secured to the backrest portion to shield a child from sunlight.

4 Claims, 1 Drawing Sheet

FLOATING CHILD RESTRAINT ASSEMBLY

BACKGROUND OF THE INVENTION

The present invention relates to a child seat that allows a toddler or infant to safely float in a swimming pool.

DESCRIPTION OF THE PRIOR ART

Families with toddlers or infants often participate in boating, swimming and similar water sports which can be dangerous if the child has not yet learned to swim. If the child falls into the water, it may drown immediately before an adult can rescue the child. In addition, small children usually enjoy being in the water. The child, however, must be held in the parent's arms which is burdensome and potentially dangerous in that the child can easily slip from the parent's grasp. Conventional flotation devices such as rafts and buoyant sleeves are unsuitable for toddlers. Accordingly, there is currently a need for a device which allows an infant or a toddler to safely float in the water.

Various flotation devices exist in the prior art. For example, U.S. Pat. No. 5,409,411 issued to Schrieber discloses a life preserver child bed flotation assembly having a base with an annular flotation collar attached to the base framework and a shell shaped seat for reclining a child being supported on the base.

U.S. Pat. No. 5,411,425 issued to Rinker discloses a flotation apparatus comprising a generally rectangular air bag with an inflation hose and valve. The unit is combined with a water craft to yield a flotation apparatus.

U.S. Pat. No. 4,962,921 issued to Simmons discloses an inflatable aquatic device comprising one or more inflatable chambers in a configuration for supporting a user. A remote control device can cyclically inflate and deflate at least one of the inflatable chambers in a manner to impart an oscillatory, vibrating or acceleratory motion to the device.

U.S. Pat. No. 5,358,438 issued to Wolfe relates to a flotation device having at least two openings and two inflatable bladders each having a valve.

U.S. Pat. No. 4,861,301 issued to Pomeroy et al relates to a personal flotation system including a haversack adapted to securely hold an ice chest and having a strap means to releasably attach the haversack to a torrid flotation device.

U.S. Pat. No. 2,623,574 issued to Damsch discloses an air mattress.

Although various flotation devices exist in the prior art, none relate to an easy to use, inexpensive to manufacture child seat that floats when placed in water. The device further includes a means for ensuring that the seat floats in an upright position.

SUMMARY OF THE INVENTION

The present invention relates to a floating child seat which may be interchangeably used in a boat, a car or as a floating device in a swimming pool. The device comprises a seat member having a back rest portion perpendicularly extending therefrom. On the back rest portion are two pairs of opposing slots which receive a pair of straps for securing an infant within the seat. On each side of the device are upper and lower flotation devices for suspending the device in a body of water. Attached to the lower surface of the seat member is a weight to keep the device in an upright position when placed in the water. The top edge of the back rest has an aperture which receives a removable umbrella member for shielding the child from sunlight. It is therefore an object of the present invention to provide a child safety seat which floats in an upright position when placed in a body of water.

It is yet another object of the present invention to provide a child safety seat which may be interchangeably used as a flotation device or a car seat.

It is yet another object of the present invention to provide a child safety seat with a removable umbrella secured thereto to shield a child from sunlight. Other objects, features and advantages of the present invention will become readily apparent from the following detailed description of the preferred embodiment when considered with the attached drawings and the appended claims.

DESCRIPTION OF THE PREFERRED EMBODIMENT

Figure 2:
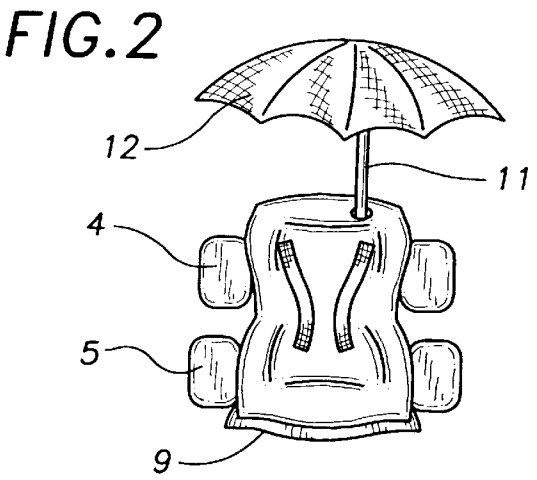
FIG. 2 depicts a rear view of the inventive device.
Figure 3:
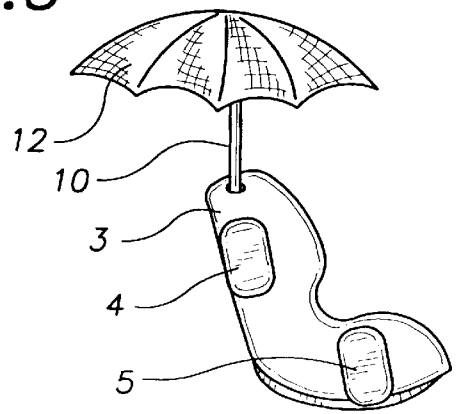
FIG. 3 is a side view of the inventive device.
Figure 1:
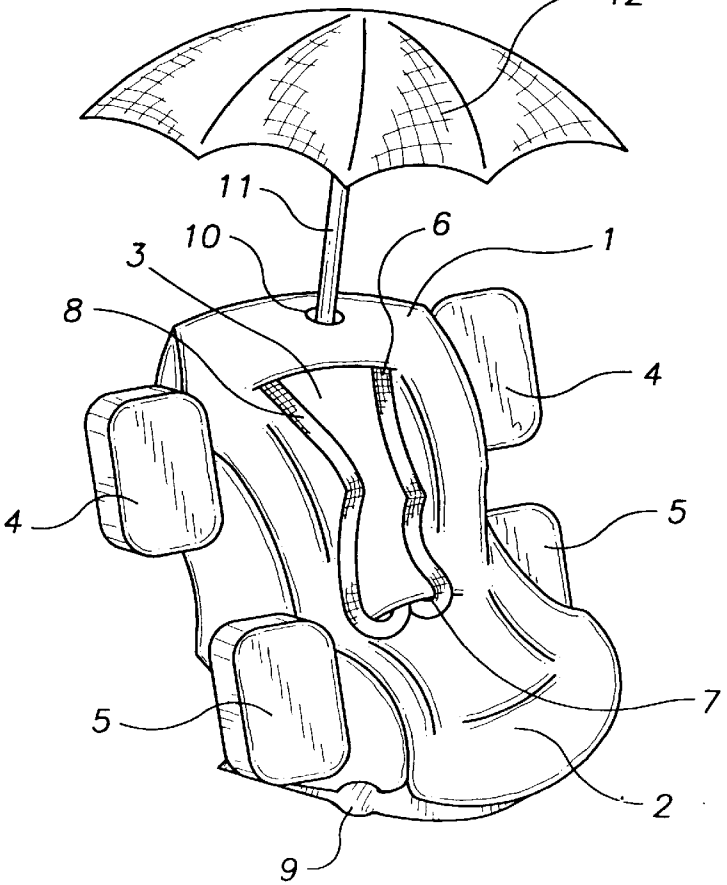
FIG. 1 depicts the inventive device.

Referring now to FIGS. 1 through 3, the present invention relates to a floating child restraint assembly. The device comprises a chair member 1 having a substantially horizontal seat portion 2 with a perpendicular back rest portion 3 integrally extending therefrom. On opposing sides of the chair member are upper 4 and lower 5 inflatable flotation devices for suspending the chair member on the surface of a body of water. The flotation devices are substantially square and are preferably placed proximal the seat portion and the top edge of the back rest. As opposed to being inflatable, the flotation devices may be made from a suitable lightweight material that floats sufficiently when placed in water to provide buoyancy to the device. The number and arrangement of flotation devices may be varied without departing from the spirit of the present invention. For example, a single flotation device may be strategically disposed on each side of the chair member. The flotation devices may be secured to the chair member using any conventional attachment means.

The back rest portion 3 has a pair of upper 6 and lower 7 slits to provide a shoulder harness assembly to secure the child in the chair member. A strap 8 extends from each upper slit to the lower slit for encompassing a child's shoulder. The length of each strap is selectively adjustable using conventional means such as a buckle or Velcro® to tightly fit the straps about various size infants. The shoulder harness is similar to that found on standard child seats and is therefore not described nor depicted in detail.

Secured to the bottom surface of the seat portion is a weight 9 which maintains the chair member in an upright position when placed in a body of water. The weight is preferably manufactured with stainless steel and is encased within a plastic covering. The back rest has an aperture 10 on its top distal edge which removably receives an elongated shaft 11 having an umbrella 12 at a distal end thereof. The umbrella will shield a child seated in the chair member from direct sunlight and will make the seat assembly more conspicuous. Accordingly, the umbrella preferably has a bright or flamboyant exterior surface.

The chair member is preferably manufactured with a plastic or closed cell injected foam and may have a logo or trademark embossed thereon. However, as will be readily apparent to those skilled in the art, the size, shape and materials of construction of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A floating child restraint assembly comprising:

a chair member having two opposing sides, said chair member including a horizontal seat portion having a top surface on which a child sits and a bottom surface, said chair member also including a backrest portion vertically extending from said seat portion, said backrest portion having front and rear surfaces and a top distal edge having an aperture thereon;

a flotation member secured to each opposing side of the chair member for suspending the chair member on the surface of a body of water;

means for securing a child within the chair member;

an elongated tubular shaft removably received within the aperture on said backrest, said shaft having an umbrella at a distal end thereof;

a weight secured to the bottom surface of said seat portion to maintain said backrest portion in a vertical, upright position when said chair member is placed in a body of water.

2. A device according to claim 1 wherein said means for securing a child within said chair member includes a pair of adjustable shoulder straps extending from the front surface of said backrest member, each of which encompass a child's shoulder to secure the child within the chair member.

3. A device according to claim 2 wherein said flotation members are hollow and inflatable.

4. A device according to claim 3 wherein said umbrella is brightly colored so as to be readily visible by those nearby.

* * * * *